US006071189A

United States Patent [19]

Blalock

[11] Patent Number: 6,071,189

[45] Date of Patent: Jun. 6, 2000

[54] AIR CIRCULATION SYSTEM AND METHOD WITH RETURN DUCT VENTILATION

[76] Inventor: D. Braxton Blalock, 4424 Jett Rd. NW., Atlanta, Ga. 30327

[21] Appl. No.: 08/966,918

[22] Filed: Nov. 10, 1997

[51] Int. Cl.[7] ..... F24F 7/08

[52] U.S. Cl. ..... 454/236; 454/252; 454/342

[58] Field of Search ..... 454/229, 233, 454/236, 251, 252, 342

[56] References Cited

U.S. PATENT DOCUMENTS

| | | | |
|---|---|---|---|
| 2,212,356 | 8/1940 | Shure | 454/236 X |
| 2,286,115 | 6/1942 | Shelton | 454/236 |
| 2,507,057 | 5/1950 | Solberg | 454/230 |
| 3,946,575 | 3/1976 | Barr et al. | 62/176 |
| 4,062,400 | 12/1977 | Horowitz | 454/236 X |
| 4,407,185 | 10/1983 | Haines et al. | 454/252 X |
| 4,589,476 | 5/1986 | Berner | 165/54 |
| 4,633,768 | 1/1987 | Benson | 454/236 |
| 4,898,086 | 2/1990 | Norris . | |
| 5,031,515 | 7/1991 | Niemela et al. . | |

*Primary Examiner*—Harold Joyce

*Attorney, Agent, or Firm*—Thomas, Kayden, Horstemeyer & Risley, LLP

[57] ABSTRACT

An air circulation system with standard and dual mode operations rapidly ventilates an enclosed area with fresh external air in the dual mode. In the dual mode of operation of the preferred embodiment, multiple barriers operate to create two airflow pathways. Two return air duct apertures are opened to expose the return air duct to an external air supply area via a fresh air duct. The fresh air duct includes an opening to the external air supply area and two extensions that are coupled to the return air duct apertures. The barriers simultaneously operate to block the return air duct between the two return air duct apertures to form two distinct return air duct segments. A central air unit and an exit fan, such as an attic fan, cooperate with the barriers to establish two airflow pathways through the return air duct segments. The first airflow pathway extends from the external air supply area through the fresh air duct through the first return air duct segment directly into the enclosed area before removal by the exit fan, and the second airflow pathway extends from the external air supply area through the fresh air duct through the second return air duct segment through the central air unit through a supply duct into the enclosed area before removal by the exit fan.

24 Claims, 2 Drawing Sheets

AIR CIRCULATION SYSTEM AND METHOD WITH RETURN DUCT VENTILATION

BACKGROUND OF THE INVENTION

The present invention relates generally to the field of enclosure ventilation, and more specifically, to the field of enclosure ventilation by exchanging air from an enclosure with external air.

As consumers become more aware of energy conservation, they correspondingly demand more tightly constructed enclosures. There is, therefore, a need to suitably ventilate the enclosures by replacing stale and possibly harmful air with fresh external air. In a conventional air conditioning system, air is conditioned by a central air unit and discharged into an enclosure via a supply air duct. The conditioned air is allowed to disperse through the enclosure and is then drawn into a return air duct, where it is returned to the central air unit for reconditioning. While the conventional air conditioning system provides adequate temperature control, it does not afford a means for ventilating the enclosure with fresh air.

One device that ventilates an enclosure by mixing outdoor air with conditioned air is an attic fan. Typically, the attic fan ventilates an enclosed area by drawing out the stale enclosed air while drawing in fresh outdoor air from selectively opened doors and windows. While the attic fan is a feasible solution, there exist problems associated with the attic fan such as inconvenience, poor filtration, and inefficient ventilation. For example, opening and closing various doors and windows can be a considerable nuisance, particularly when ventilating large enclosures. In addition, even if the doors and windows include screens, foreign particles such as pollen, microscopic bugs, smoke, and odors can still be admitted. Furthermore, an attic fan with selectively opened doors and windows, may unevenly ventilate areas, leaving some areas poorly ventilated.

There is, therefore, a need in the industry for a method and an apparatus for addressing these and other related, and unrelated, problems.

SUMMARY OF THE INVENTION

According to the first preferred embodiment of the present invention, an air circulation system with standard and dual mode operations is utilized to rapidly ventilate an enclosed area with fresh external air. In the standard mode of operation, which is equivalent to a conventional air conditioning scheme, a central air conditioning unit draws air from the enclosed area through the return air duct. It then conditions the air before discharging the conditioned air into the enclosed area through the supply air duct. After the air is allowed to spread into the enclosed area, the central air unit draws the air back for reconditioning via the return air duct, and the process is repeated.

In the dual mode of operation, multiple barriers operate to create two airflow pathways. Two return air duct apertures are opened to expose the return air duct to an external air supply area via a fresh air duct. The fresh air duct includes an opening to the external air supply area and two extensions that are coupled to the return air duct apertures. The barriers simultaneously operate to block the return air duct between the two return air duct apertures to form two distinct return air duct segments.

The central air unit and an exit fan, such as an attic fan, are employed to establish two airflow patterns through the respective airflow pathways. The exit fan creates the first air flow pattern by drawing external air from the external air supply area through the fresh air duct. A filter mounted to the fresh air duct, filters external air of any impurities, such as pollen, bugs, smoke, and odors, before the air is drawn into the fresh air duct. The exit fan draws filtered external air from the fresh air duct through the first duct extension and into the enclosed area through the first return air duct segment, where the exit fan expels the air from the area. Note that the airflow direction in a portion of the return air duct is reversed from the standard mode of operation.

In the first preferred embodiment of this present invention, an auxiliary fan is mounted within the first fresh air duct extension to supplement the exit fan by independently drawing filtered external air from the fresh air duct and forcing the air into the enclosed area. The auxiliary fan may also, depending on the desire of the operator, work in unison with a cooling coil which is also mounted within the first fresh air duct extension. The purpose of the cooling coil is to cool the external air to a desired temperature as external air flows across it. Of course, in other embodiments of the present invention, the auxiliary fan and the cooling coil are omitted. In still other embodiments, a larger cooling coil is mounted to affect both fresh air duct extensions so that all external air is cooled before entering the return air duct.

The second air flow pattern also originates from the external air supply area via the fresh air duct. The central air unit draws filtered external air into the unit, through the second fresh air duct extension and the second return air duct segment, where it conditions and discharges the air into the enclosed area through the supply air duct before the exit fan expels the air from the enclosed area. Of course, the operator is also allowed to run only the fan of the central air unit since most conventional central air units allow fan operation without conditioning.

Thus, in accordance with the first preferred embodiment of the present invention, dual airflow patterns are created via the supply and return air ducts, producing rapid ventilation of the enclosed area. This is especially advantageous for extracting tobacco smoke, cleaning agent fumes, and other toxic gases. Utilizing both supply and return vents are also advantageous in multi-room enclosures. Since each room is typically equipped with supply air vents and return air vents, each room will be thoroughly ventilated.

It is, therefore, an object of the present invention to provide an air circulation system for rapidly ventilating an enclosure of toxic fumes and particles.

Another object of the present invention to provide a convenient air circulation system that does not require opening numerous doors and windows.

Yet another object of the present invention is to provide an efficient air circulation system for complete and thorough ventilation of various areas of an enclosure.

Still another object of the present invention is to provide an air circulation system including a filter for removing gases and fine particles (such as pollen, microscopic bugs, smoke, and odors) from external air before the air enters an enclosed area.

Another object of the present invention is to provide an economical air circulation system so that colder external air is used to cool an enclosed area.

Yet another object of the present invention is to provide an air circulation system including a cooling coil which cools external air before it enters an enclosed area.

Still another object of the present invention is to provide an air circulation system where external air is drawn from both a return air duct and a supply air duct.

Another object of the present invention is to provide an air circulation system including an auxiliary blower that independently forces external air through a return air duct into an enclosed area.

Still another object of the present invention is to provide an air circulation system where external air is forced out both the return air duct and supply air duct while simultaneously being drawn outside the enclosure by an exit fan.

Yet another object of the present invention is to provide a retrofit kit which includes an air circulation system for rapidly ventilating an enclosure of toxic fumes and particles.

Another object of the present invention is to provide an air circulation retrofit kit that can be attached to a return air duct of existing air conditioning systems.

Other objects, features and advantages of the present invention will become apparent upon reading and understanding the present specification, when taken in conjunction with the accompanying drawings.

Figure 1:
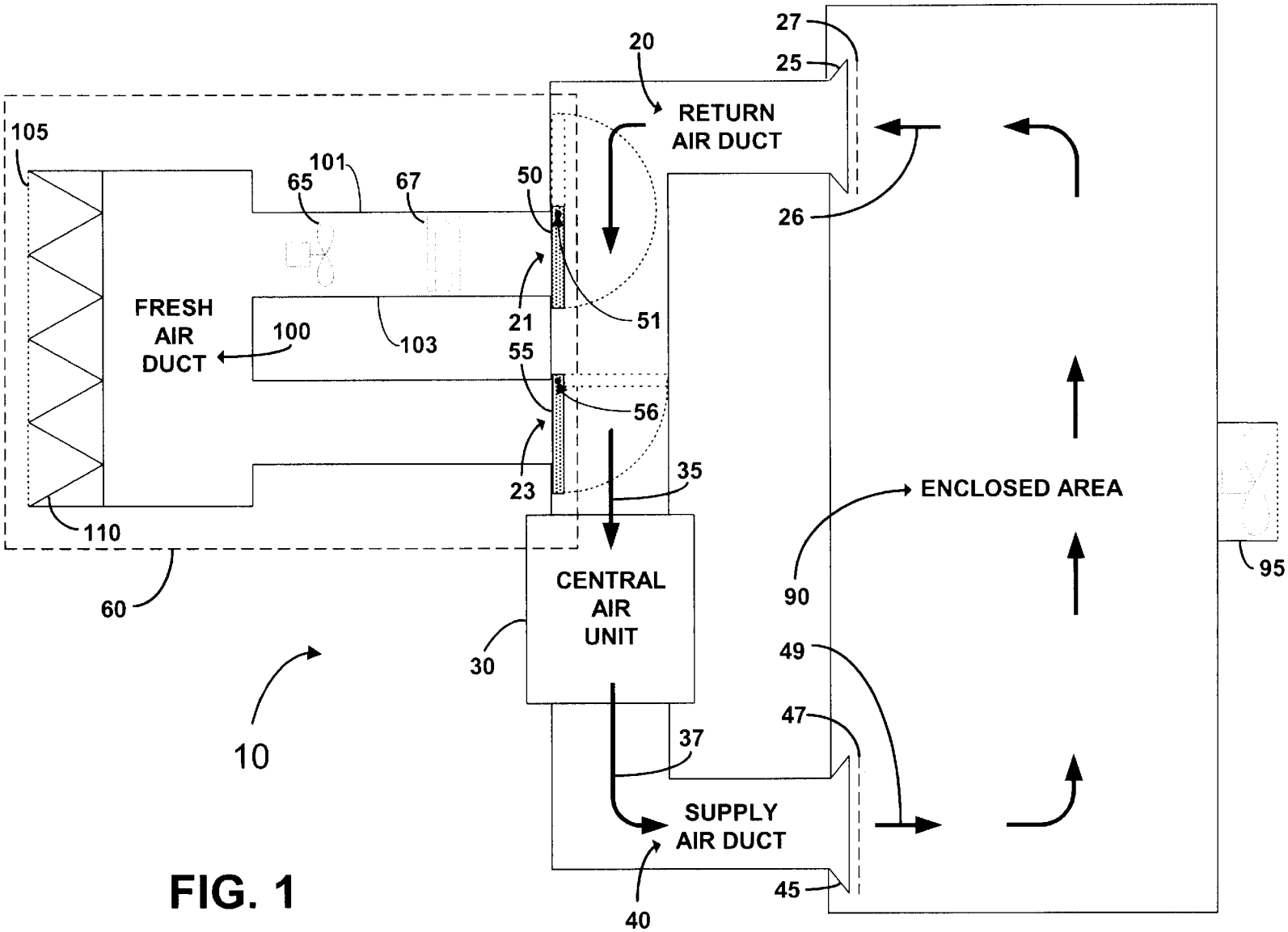
FIG. 1 is a schematic view of the present invention showing air flow patterns when in a standard mode of operation in accordance with the first preferred embodiment of the present invention.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications, and equivalents included within the spirit and scope of the invention as defined by the appended claims.

DETAILED DESCRIPTION OF THE PREFERRED EMBODIMENT

Referring now in greater detail to the drawings in which like numerals represent like components throughout the several views, FIG. 1 shows a schematic view of an air circulation system 10 in accordance with the first preferred embodiment showing the air flow pattern when in a standard mode of operation. The air circulation system 10 is shown with a return air duct 20 that takes air from an enclosed area 90 through a return air duct vent 25. The flow of the air taken into this vent 25 is indicated by arrow 26. The return air duct 20 is shown to be connected to a conventional air conditioning unit termed the central air unit 30. It is recognized that the central air unit 30 may be of any type known to one reasonably skilled in the art.

A closing mechanism is also included within this present invention for blocking return air duct apertures 21 and 23, and thereby directing the airflow in the return air duct 20 into the central air unit 30. In FIG. 1, the closing mechanism is shown as two movable barriers 50 and 55 preferably coupled to hinges 51 and 56, respectively. The barriers 50 and 55 pivot on hinges 51 and 56, respectively, and are coupled with appropriate actuating means to swing the barriers 50 and 55 between open and closed positions. In the first preferred embodiment, the actuating means transition both barriers 50 and 55 concurrently from an open position to a closed position when operation of an exit fan 95 is terminated. The actuating means may be multi-bar actuators, electro-servo motors, or any other means known to one reasonably skilled in the art sufficient to cause barriers 50 and 55 to cover or uncover apertures 21 and 23 respectively. It is recognized that other types of closing mechanisms, known to one reasonably skilled in the art, may be utilized. For example, other closing mechanisms include, but are not limited to: adjustable dampers with single louvers, adjustable dampers with multiple louvers, and slide doors. It is also noted that actuating means are not included in other embodiments when the closing mechanism can be physically opened and closed by the consumer. While the exit fan 95 is a variable speed fan in the first preferred embodiment of the present invention, other preferred embodiments include fixed speed fans.

Referring back to FIG. 1, the central air unit 30 draws air from the return air duct 20, as indicated by arrow 35, and conditions the air before discharging the conditioned air into a supply air duct 40, as indicated by arrow 37. The conditioned air is then expelled out of the supply air duct 40 into the enclosed area 90 through a supply air duct vent 45, as indicated by arrow 49. A diffuser 47 is preferably provided at the supply air duct vent 45 to spread the expelled air as it enters the enclosed area 90. After the air is allowed to disperse into the enclosed area 90, the central air unit 30 draws the air back for reconditioning via the return air duct vent 25 and duct 20.

Under normal operating conditions, the central air unit 30 draws in warm air from the enclosed area through the return air duct 20 and vent 25. It then cools and discharges the conditioned air into the enclosed area 90 through the supply air duct 40 and supply air duct vent 45, as described above. An external air supply system 60 is shown in FIG. 1 as being closed off by movable barriers 50 and 55. In this closed position, the air circulation system 10 operates in a standard mode similar to a conventional air conditioning scheme.

Figure 2:
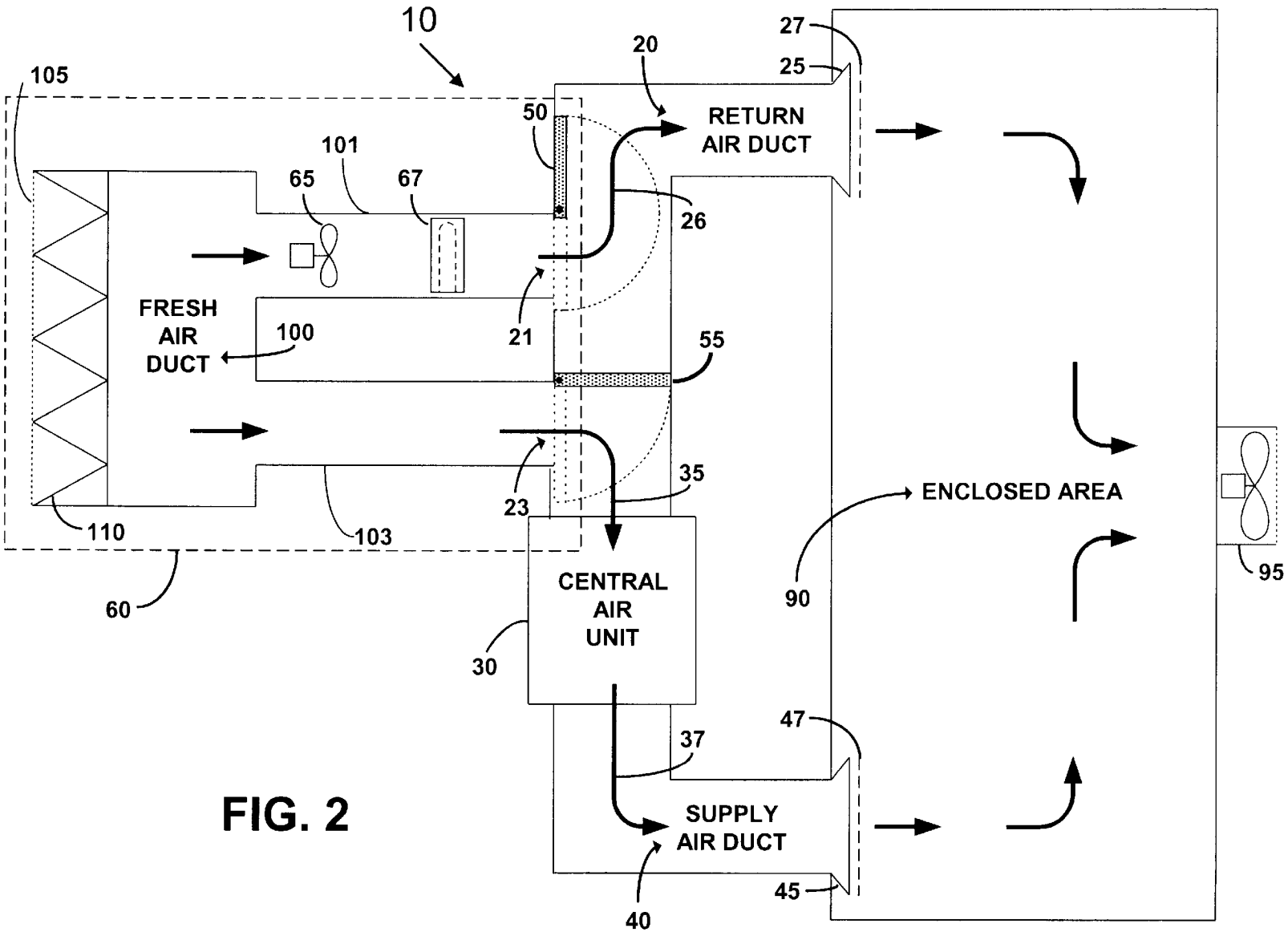
FIG. 2 is a schematic view of the present invention showing air flow patterns when in a dual mode of operation in accordance with the first preferred embodiment of the present invention.

Refer now to FIG. 2 for a schematic view of the air circulation system 10 in accordance with the first preferred embodiment showing air flow patterns when in the dual mode of operation. The exit fan 95 is coupled to the enclosed area 90 for removing air from the area 90. In accordance with the first preferred embodiment of the present invention, an attic fan is utilized as the exit fan 95. However, it is recognized that other methods for drawing air from an enclosed space are utilized in alternate embodiments of the present invention.

In the dual mode of operation, movable barriers 50 and 55 operate to create two airflow pathways. Referring back to FIG. 2, the barriers 50 and 55 are shown in open positions permitting external air to enter the return air duct 20 through the return air duct apertures 21 and 23. The barrier 55 is shown to simultaneously block the return air duct 20 between the two return air duct apertures 21 and 23 to form two distinct return air duct segments. It is recognized that the scope of the present invention also includes any mechanism for maintaining the movable barriers in partially open and closed positions, depending upon the desired results of external air mixture and pressure equalization.

The external air supply system 60 includes a fresh air duct 100 having an opening 105 to an external air supply area and two extensions 101 and 103 that are coupled to the return air duct apertures 21 and 23, respectively. A filter 110, shown mounted to the fresh air duct opening 105, filters external air of any impurities before the air is drawn into the fresh air duct 100. Filter 110 includes, in the preferred embodiment, one of any gas filtration assemblies known in the industry that permit removal of common impurities from air, such as pollen, bugs, smoke, and odors. It is recognized that other known types of filter material, such as, for example, activated carbon, may be used in the present invention depending upon existing conditions and consumer preference.

The exit fan 95 establishes the first airflow pattern by drawing filtered external air from the fresh air duct 100, through the fresh air duct extension 101 and through the return air duct aperture 21. The air is then drawn through a first return air duct segment, as indicated by arrow 26, and into the enclosed area 90 via the return air duct vent 25. The exit fan 95 subsequently expels the air from the area 90. Note, the reversal of airflow direction in the return air duct 20 from the standard mode of operation of FIG. 1. A diffuser 27 is preferably provided at the return air duct vent 25 to spread the expelled air as it enters the enclosed area 90.

In accordance with the first preferred embodiment of the present invention, an auxiliary fan 65 is mounted within the fresh air duct extension 101. It operates to supplement the exit fan 95 by independently drawing filtered external air through the fresh air duct 100 and forcing the air into the return air duct 20, where it is expelled into the enclosed area 90. The auxiliary fan 65 also works in unison with a cooling coil 67, which is also preferably mounted within the fresh air duct extension 101. The purpose of the cooling coil 67 is to cool the external air to a desired temperature as external air flows across it. It is recognized that the cooling coil 67 may be of any known type used in ventilation apparatuses. Although in accordance with the first preferred embodiment of this present invention, the cooling coil is utilized in conjunction with the auxiliary fan 65, it should be apparent that each one may be used independently from each other.

The second air flow pattern, represented by arrows 35 and 37, also originates from the fresh air duct 100. The central air unit 30 draws filtered external air from the fresh air duct 100, through the fresh air extension 103 and through the return air duct aperture 23 into a second return air duct segment. The air is then drawn into the central air unit 30 where the central air unit 30 conditions the air before discharging it into the supply air duct 40. However, it should be apparent that the central air unit 30 may, as operated by the consumer, be utilized only to draw external air into the enclosed area 90 without cooling the air. The conditioned air is forced through the supply air duct 40 and into the enclosed area 90 via the supply air duct vent 45 and diffuser 47. The exit fan 95 subsequently expels the air from the area 90.

Thus, in accordance with the first preferred embodiment, dual airflow patterns are created via the supply air duct 40 and return air duct 20, thereby producing rapid ventilation of the enclosed area 90. This is especially advantageous for extracting tobacco smoke, cleaning agent fumes, and other toxic particles. Utilizing both supply and return vents 47 and 27 are also advantageous in multi-room enclosures.

One preferred construction method for building the air circulation system 10 is to fabricate the complete structure in parallel with the desired ventilated area. Of course, another example of a preferred construction method is to install a retrofit kit onto the return air duct of an existing conventional air conditioning system. Referring to FIG. 1, the retrofit kit essentially includes the external supply system referred to generally as 60. However, it is recognized that alternate configurations may be desired depending upon the existing conventional air conditioning system and consumer preference.

According to a second preferred embodiment of the present invention, the extension 103 and barrier 55 are removed from the system 60. In this embodiment, external air is drawn through extension 101 and return air duct 20 directly to enclosed area 90 and through extension 101 and return air duct 20 to central air unit 30. Thus, this second embodiment still reverses the airflow through a portion of the return air duct 20. Furthermore, this second embodiment trades off functionality for simplicity and lower cost.

In the first preferred embodiment of the present invention, electrical controls for the exit fan 95 and the movable barriers 50 and 55 are separated. In another preferred embodiment, the electrical controls are connected such that initiation of operation of the exit fan 95 also causes the movable barriers 50 and 55 to move from the closed positions of FIG. 1 to the open positions of FIG. 2. Likewise, termination of the exit fan 95 results in the movable barriers 50 and 55 moving back to the closed positions of FIG. 1. The details of such a basic electrical connection would be readily understood by those reasonably skilled in the art of the present invention.

It should also be understood that air from any area outside the enclosed area should be considered to be external or fresh air. Thus, for example, air from a basement or crawl space is considered, for some alternate embodiments, to be external air for purposes of the present invention. Also, in one sense, the present invention teaches selectively opening an air pathway between an external area and any air duct for an enclosed space in conjunction with a separate mechanism for removing air from the enclosed space.

In addition, while the cooling coil 67 is cooled through a conventional gas refrigerant system in one embodiment of the present invention, another embodiment includes a system for pumping water from a large natural reservoir, such as a lake, whereby the water is cooler than the ambient air temperature during hot months and warmer than the ambient air temperature during the cooler months, thus providing cooling and heating effects as necessary. Of course, in other embodiments of the present invention, the auxiliary fan and the cooling coil are omitted. In still other embodiments, a larger cooling coil is mounted to affect both fresh air duct extensions so that all external air is cooled before entering the return air duct.

While the embodiments of the present invention which have been disclosed herein are the preferred forms, other embodiments of the method and apparatus of the present invention will suggest themselves to persons skilled in the art in view of the foregoing description. Therefore, it will be understood that variations in form, construction, and arrangement of the parts can be effected within the spirit and scope of the invention without sacrificing its material advantages. Furthermore, the scope of the present invention should only be limited by the claims below.

I claim:

1. An air circulation apparatus for supplying external air from an external area into an enclosed area, the air circulation apparatus comprising:

an air conditioning unit;

a supply air duct connected between said air conditioning unit and the enclosed area;

a return air duct connected between the enclosed area and said air conditioning unit;

a fresh air duct connected between the external area and said return air duct; and an exit fan coupled to the enclosed area to ventilate the enclosed area by removing air from the enclosed area for replacement by external air flowing through said fresh air duct and into the enclosed area directly from said return air duct.

2. The apparatus recited in claim 1, wherein said exit fan is an attic fan.

3. The apparatus recited in claim 1, further comprising an auxiliary blower located within said fresh air duct and configured to supplement the operation of said exit fan by independently forcing said external air through said return air duct directly into the enclosed area.

4. The apparatus recited in claim 1, further comprising a cooling coil located within said fresh air duct and configured to cool the external air.

5. The apparatus recited in claim 1, further comprising a movable barrier coupled to said return air duct and configured to selectively block the external air from flowing to said return air duct.

6. The apparatus recited in claim 5, wherein said movable barrier transitions from a closed position to an open position in response to initiation of operation of said exit fan and moves from said open position to said closed position in response to termination of operation of said exit fan.

7. The apparatus recited in claim 1, wherein said return air duct defines a first return air duct aperture through which the external air selectively flows from said fresh air duct into said return air duct and a second return air duct aperture through which the external air selectively flows from said fresh air duct into said return air duct.

8. The apparatus recited in claim 7, further comprising:

a first movable barrier so coupled to said return air duct that said first movable barrier is selectively movable between a closed position blocking the external air from flowing through said first aperture into said return air duct and an open position allowing the external air to flow through said first aperture into said return air duct; and a second movable barrier so coupled to said return air duct that said second movable barrier is selectively movable between a closed position blocking the external air from flowing through said second aperture into said return air duct and an open position allowing the external air to flow through said second aperture into said return air duct.

9. The apparatus recited in claim 8, wherein said first movable barrier and said second movable barrier operate in unison to selectively create a first airflow pathway extending from the external area through said return air duct directly into the enclosed area and a second airflow pathway extending from the external area through said return air duct and said air conditioning unit into the enclosed area.

10. The apparatus recited in claim 8, wherein, in response to initiation of operation of said exit fan, said first movable barrier and said second movable barrier transition from said closed position to said open position, and wherein, in response to termination of operation of said exit fan, said first movable barrier and said second movable barrier transition from said open position to said closed position.

11. An air circulation method comprising steps of:

supplying external air from an external area into a return air duct coupled to an enclosed area and to a central air unit; and removing air from the enclosed area to allow external air to flow through the return air duct directly into the enclosed area.

12. The method of claim 11, wherein said removing air step includes operating an exit fan coupled to the enclosed area.

13. The method of claim 11, wherein said supplying step is so responsive to said removing step that external air only flows into the enclosed area in response to said removing step.

14. The method of claim 11, further comprising a step of blowing external air into the enclosed area.

15. The method of claim 11, wherein said supplying step includes supplying external air into the enclosed area through a first pathway through the return air duct directly into the enclosed space and through a second pathway through the return air duct through the central air unit through a supply duct into the enclosed space.

16. An air circulation apparatus for supplying external air from an external area into an enclosed area, the air circulation apparatus comprising:

conditioning means for conditioning air;

supply means for supplying conditioned air to the enclosed area;

return means for returning air from the enclosed area to said means for conditioning air;

ventilation means for ventilating the enclosed area; and circulation means for passing external air through the enclosed area from said return means to said ventilation means.

17. The apparatus recited in claim 16, further comprising cooling means for cooling the external air.

18. The apparatus recited in claim 17, further comprising barrier means for selectively blocking the external air from flowing to said return means.

19. An air circulation method comprising steps of:

operating an air duct, said air duct being coupled to an enclosed area and to a central air unit, in a first mode of operation in which air from an enclosed area flows in a first direction through the air duct;

operating the air duct in a second mode of operation in which external air from an external area is supplied into the air duct and in which air flows through at least a portion of the air duct in a second direction opposite the first direction; and removing air from the enclosed area to allow external air to flow through the air duct into the enclosed area in the second mode of operation of the air duct.

20. The method of claim 19, wherein the air duct is a return air duct.

21. The method of claim 20, wherein the second direction is one in which air is supplied into the enclosed area directly from the return air duct.

22. The method of claim 19, wherein said removing air step includes operating an exit fan coupled to the enclosed area.

23. The method of claim 19, wherein said supplying step is so responsive to said removing step that external air only flows into the enclosed area in response to said removing step.

24. The method of claim 19, wherein said supplying step includes supplying external air into the enclosed area through a first pathway through a return air duct directly.

* * * * *